US005582137A

United States Patent [19]

Brady et al.

[11] Patent Number: 5,582,137

[45] **Date of Patent: *Dec. 10, 1996**

[54] COMPACT BOILER HAVING LOW NOX EMISSIONS

[75] Inventors: Robert T. Brady, Elmhurst; Joseph H. Werling, Mundelein, both of Ill.

[73] Assignee: Mark IV Transportation Products Corp., Niles, Ill.

[ * ] Notice: The term of this patent shall not extend beyond the expiration date of Pat. No. 5,333,574.

[21] Appl. No.: 215,835

[22] Filed: Mar. 22, 1994

Related U.S. Application Data

[63] Continuation-in-part of Ser. No. 972,358, Nov. 5, 1992, Pat. No. 5,333,574, which is a continuation-in-part of Ser. No. 760,023, Sep. 11, 1991, Pat. No. 5,259,342.

[51] Int. Cl.[6] ..... F22B 37/10

[52] U.S. Cl. ..... 122/367.1; 110/345; 110/347; 110/234; 431/76; 236/15 E

[58] Field of Search ..... 110/345, 347, 110/234; 122/367.1; 431/76; 236/15 E

[56] References Cited

U.S. PATENT DOCUMENTS 5,333,574 8/1994 Brady et al. ..... 122/367.1

*Primary Examiner*—Henry A. Bennett
*Assistant Examiner*—Siddharth Ohri

[57] ABSTRACT

Method and apparatus for reducing the NOX levels in stack emissions of compact boilers and fluid heaters through selective injection of exhaust flue gases into the combustion process. Flue gas injection into the primary and secondary air of the burner along with flue gas injection directly into the combustion process is utilized. Injection of generated steam obtained from various components of a compact boiler, selectively injected into the combustion process is also provided.

25 Claims, 9 Drawing Sheets

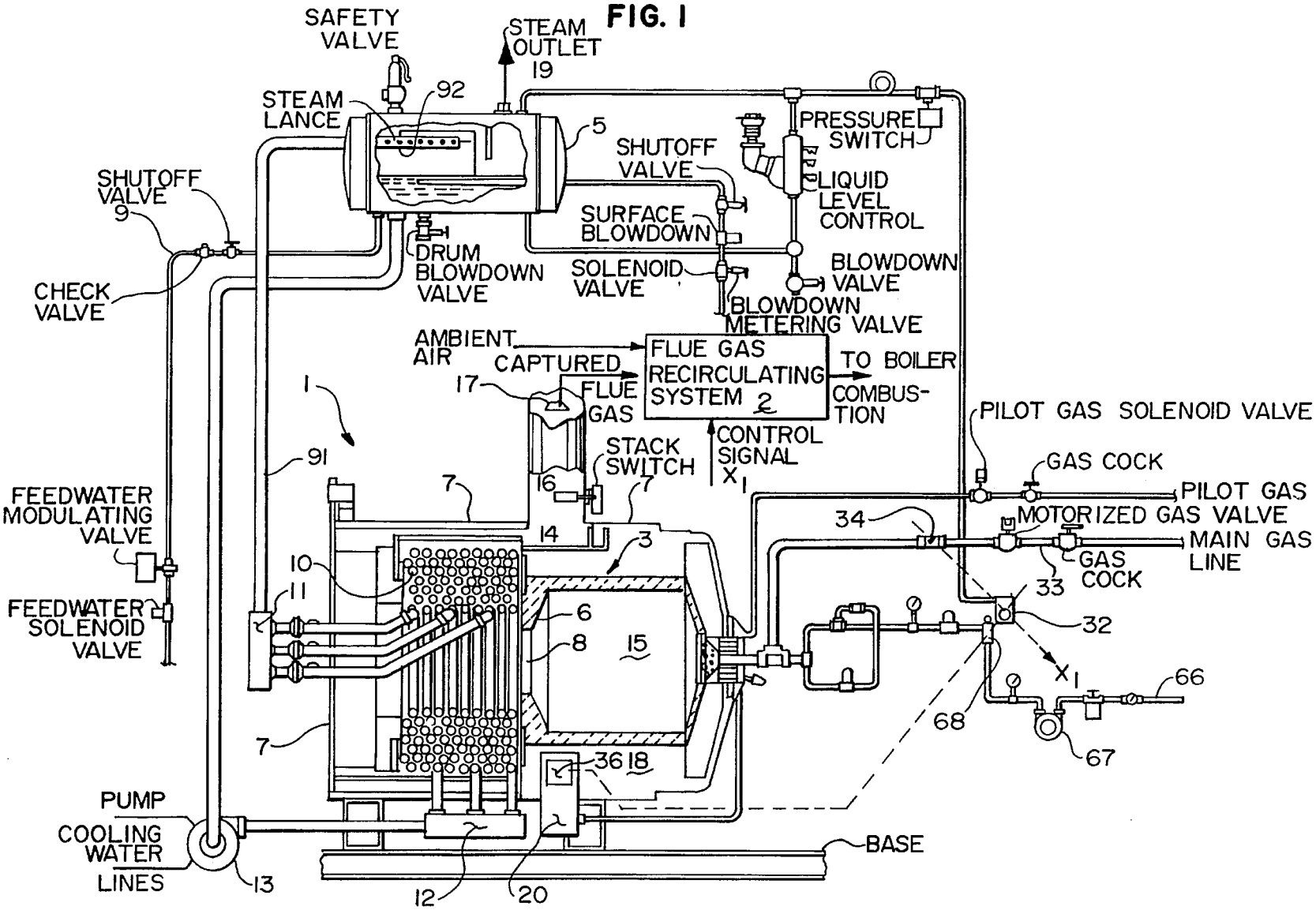
PILOT GAS SOLENOID VALVE
GAS COCK
PILOT GAS
MOTORIZED GAS VALVE
MAIN GAS LINE
GAS COCK
PRESSURE SWITCH
LIQUID LEVEL CONTROL
BLOWDOWN VALVE
BLOWDOWN METERING VALVE
TO BOILER
COMBUS-TION
FLUE GAS RECIRCULATING SYSTEM 2
CONTROL SIGNAL X1
SHUTOFF VALVE
SURFACE BLOWDOWN
SOLENOID VALVE
STACK SWITCH
FLUE GAS
CAPTURED
AMBIENT AIR
STEAM OUTLET 19
DRUM BLOWDOWN VALVE
SAFETY VALVE
STEAM LANCE
SHUTOFF VALVE 9
CHECK VALVE
FEEDWATER MODULATING VALVE
FEEDWATER SOLENOID VALVE
PUMP
COOLING WATER LINES
BASE
FIG. 1

COMPACT BOILER HAVING LOW NOX EMISSIONS

CROSS REFERENCE TO RELATED APPLICATIONS

This application is a continuation-in-part of application Ser. No. 07/972,358, filed Nov. 5, 1992, issued as U.S. Pat. No. 5,333,574, Aug. 2, 1994, which is a continuation-in-part of an application Ser. No. 07/760,023, filed on Sep. 11, 1991, issued as U.S. Pat. No. 5,259,342, Nov. 9, 1993; the specification of Ser. No. 07/972,358, now U.S. Pat. No. 5,333,574, is incorporated herein by reference.

BACKGROUND OF THE INVENTION

This invention relates generally to combustion of gaseous fuels wherein the NOX content in products of combustion or flue gases are reduced to acceptable levels. More particularly, this invention relates to low NOX combustion systems fired by fluid fuels, including oil, and other hydrocarbons such as alcohol and toluol in compact boilers and similarly constructed fluid heaters.

In the above-mentioned copending application, a system of controlling flue gas NOX content through controlling the ratios of injected flue gas, steam and ambient air, into the primary and secondary combustion air, and directly into the combustor. In that application the flue gas is scavenged or intercepted in the boiler exhaust.

Although the system disclosed in the above-mentioned co-pending application is creditable, applicants, in continuing investigation and product development, have discovered additional methods for reducing NOX, particularly in the "compact" boiler designs utilizing liquid fuels. The invention disclosed herein provides a method for reducing NOX in boiler stack emissions that is less complex, and equally effective in firing fluid fuels, including liquids.

Therefore, it is an object of this invention to provide a method and apparatus for reducing the NOX level in the stack emission of a compact boiler utilizing fluid fuels.

It is an additional object of this invention to provide a method and apparatus for reducing compact boiler NOX levels in stack emissions through controlling flue gas and/or steam injection into the primary and secondary air inputs to the boiler or heater.

It is another object of this invention to reduce the NOX content of compact boiler emissions through control of mixed tertiary air, flue gas and/or steam injection into the boiler combustion chamber.

It is a further object of the invention to provide sources of steam for NOX reduction from various components of the boiler configuration.

SUMMARY OF THE INVENTION

The method and apparatus disclosed herein utilizes a compact boiler burner and liquid fuel combustion system. Flue gas or combustion products exiting the heat exchange portion of a compact boiler and/or steam generated by the boiler is mixed with predetermined quantities of ambient or combustion air, and selectively introduced into the combustion process through use of a flue gas blower Apportioned quantities of flue gas, ambient air, steam and mixtures of these are introduced into the boiler combustion process.

In a first embodiment, a flue gas/ambient air and steam are is injected in controlled amounts apportioned among the combustion air plenum, and the burner primary air channel.

In alternative embodiments of the invention disclosed, steam obtained from one of several components of the steam generating system internal of the boiler configuration.

In an additional alternate embodiment, the mixture of flue gas and ambient air exiting a flue gas blower is injected directly into the combustion chamber of the compact boiler such that mixing of the injected flue gas and the ongoing combustion process is achieved.

An additional embodiment incorporates improved fuel/air mixing at the burner outlet.

A further embodiment of the invention incorporates use of superheated water from certain components of the boiler to generate steam for NOX reduction.

BRIEF DESCRIPTION OF THE DRAWINGS

FIG. 1 is a semi-schematic and diagrammatical section view of the compact boiler of the invention, in particular, connections to fuel and feed water inputs, combustion gas outlets and a view of the entire burner-combustion chamber structure juxtaposed in a heat transfer relationship with the steam generating or fluid heating coils are shown. Also shown are the outlet steam pressure control, combustion air, and fuel inlet valves.

While flue gas recirculation and steam injection into the combustion system of the invention disclosed herein will be described in connection with certain preferred embodiments and methods, it will be understood that it is not intended to limit the apparatus and system disclosed to those embodiments or methods. On the contrary, it is intended to cover all alternatives, modifications and equivalents as may be included within the spirit and scope of recirculated flue gas injection into combustion systems of compact boilers as defined by the appended claims.

DETAILED DESCRIPTION OF THE INVENTION

As the invention disclosed herein is primarily concerned with boilers of the compact variety having characteristics distinctly different from conventional steam boilers and/or fluid heaters, the following general description will address operation of the boiler in conjunction with the flue gas recirculating system. Subsequent description will, in much greater detail, discuss the operation and structure of applicants' novel flue gas recirculating and steam induction systems.

However, to impart a basic understanding of compact boiler operation of the type disclosed herein, it is necessary to refer to FIG. 1. It should be noted that the portions of the boiler closely associated with the invention disclosed herein will be depicted by symbols referred to in the discussion. Other elements largely included to complete applicants disclosure of the compact boiler of the invention will be described by written legends as shown. The terminology of these written legends is, as those skilled in the art will readily recognize, composed of terminology of long standing and wide acceptability in the boiler and liquid heater arts.

An additional and widespread use of the heater configuration disclosed is supplying heat to remote locations by circulating high temperature fluids. The heat transfer fluids utilized have boiling temperatures as high as 600° F. with relatively low vapor pressures. In operation, these units have no appreciable fluid vaporization, and are termed "liquid phase" heaters.

Figure 13:
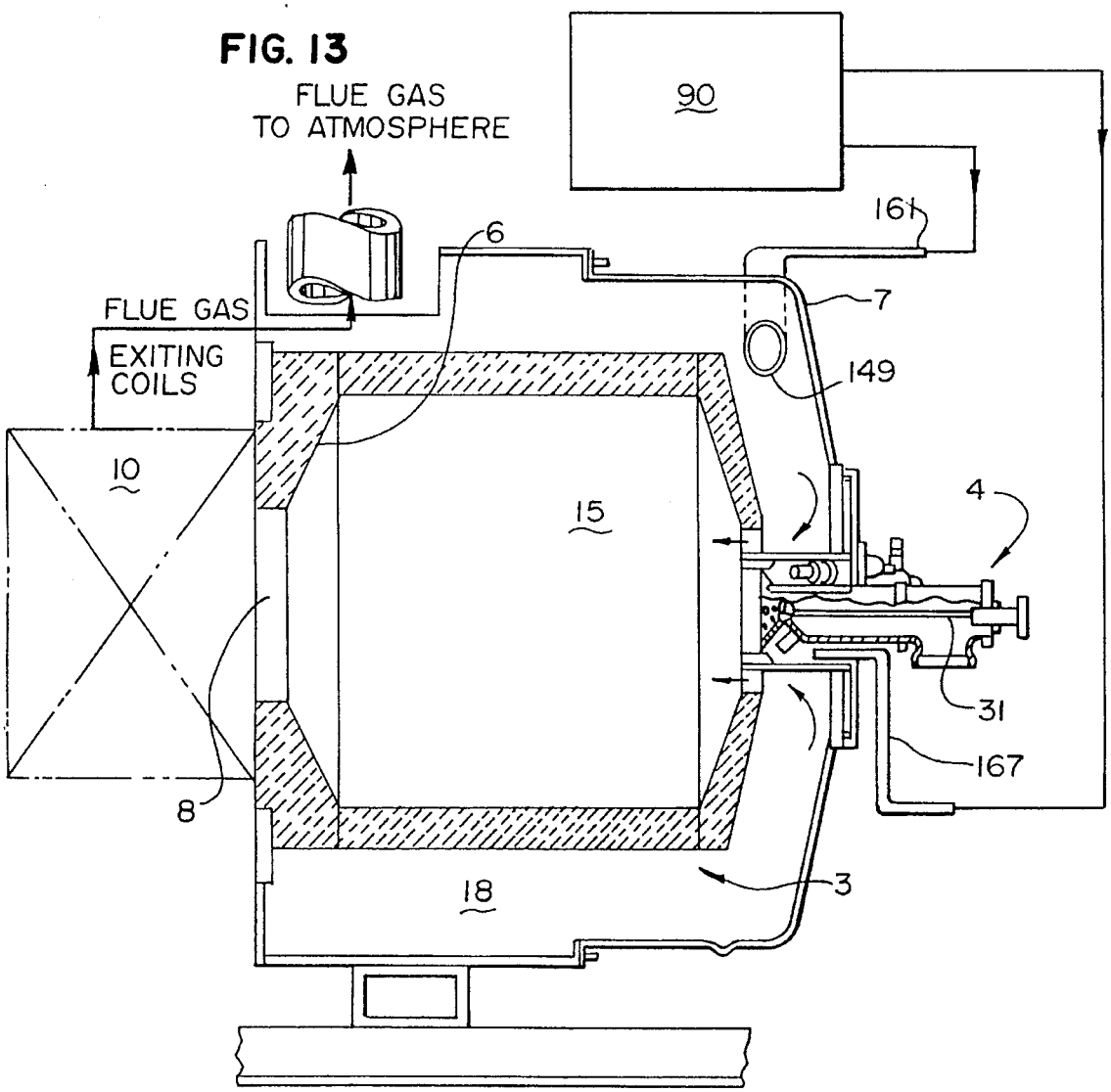
FIG. 13 is an additional semi-diagrammatical cross section of the boiler of the invention, particularly showing steam introduced to the primary and secondary air inlets of the boiler and burner. In particular, steam is obtained from a novel source depicted in subsequent FIGS. 14, 15, and 16.

Therefore, in particular reference to FIG. 1, there is shown a boiler assembly 1 having an outer shell 7 containing a refractory combustion chamber 3 having an inner volume 15 and, at its inlet end, a burner assembly 4, and, at its outlet end, a combustion choke 6 and outlet 8. In fluid communication with the combustion outlet 8 is a coil tube bank 10 through which combustion gases generated in the chamber 15 flow outward into the combustion gas plenum 14 and from there to the atmosphere through the boiler outlet or stack 16. Located in the stack 16 is a stack gas capture device or scoop 17, and duct 40 which supply flue gas to the recirculating system 2. With reference to FIGS. 1 and 13, an assembly 90 including alternate sources of boiler generated steam using superheated water from various components of the portions of the boiler of FIG. 1 shown in FIG. 13 are utilized.

As discussed above, the flue gas recirculation system 2 and superheated water steam sources of FIG. 13 comprise a major portion of the invention disclosed herein and will be discussed below in much greater detail. Also included in the boiler operation is a steam drum 5 supplied with feed water by a water supply inlet 9. Water level in the drum is maintained as shown by a water level control. Feed water is superheated by combustion gases passing through coils 10, 15, maintained above saturation temperature at a typical drum level as shown, is recirculated from the steam drum 5 by recirculating pump 13 passes through coil bank inlet manifold 12. Superheated feed water exits the manifold 12 and again passes through tube bank 10, now heated to a predetermined temperature and pressure above saturation exits the coil banks through manifold 11, passes into and through the steam lance 92 and is sprayed via the steam lance into the drum 5 as shown. Since the pumped water exiting the steam lance is above its saturation temperature, much of it flashes into steam which is delivered to an associated system having steam demand via the steam outlet 19 as shown. Outlet 19 also supplies steam for subsequent introduction into the combustion process via disclosed embodiments utilizing steam line 64 or alternate steam source 90. Return superheated water enters the drum and is recirculated via the pump 13 re-entering the coils 10 via coil inlet manifold 12.

Combustion control is accomplished through the use of a steam pressure actuator 32 operating in conjunction with variable gas flow valve 34 or liquid fuel metering valve 68. Operation of the combustion control is identical with either liquid or gaseous fuel. Pressure sensing controller 32 adjusts steam output pressure by controlling either liquid fuel flow by varying metering valve 68, or by controlling combustion gas flow from supply 33 to burner inlet 31, and further controlling ambient combustion air forced into the plenum 18 by blower 20 by adjusting blower damper control 36.

In operation, pressure associated with the steam outlet representing steam demand is applied to the pressure actuator 32 which in turn adjusts the fuel input, firing rate, and combustion air blower output in accordance with a predetermined ratio of fuel/air over a predetermined firing range of the unit. Signals representing the particular firing range associated with an any specific steam demand are thereby available for operating elements of the flue gas recirculating and steam introduction systems which will now be described in detail. Similar control of liquid phase heaters would be related to thermal load reflected in return fluid temperature drop instead of steam pressure.

Figure 2:
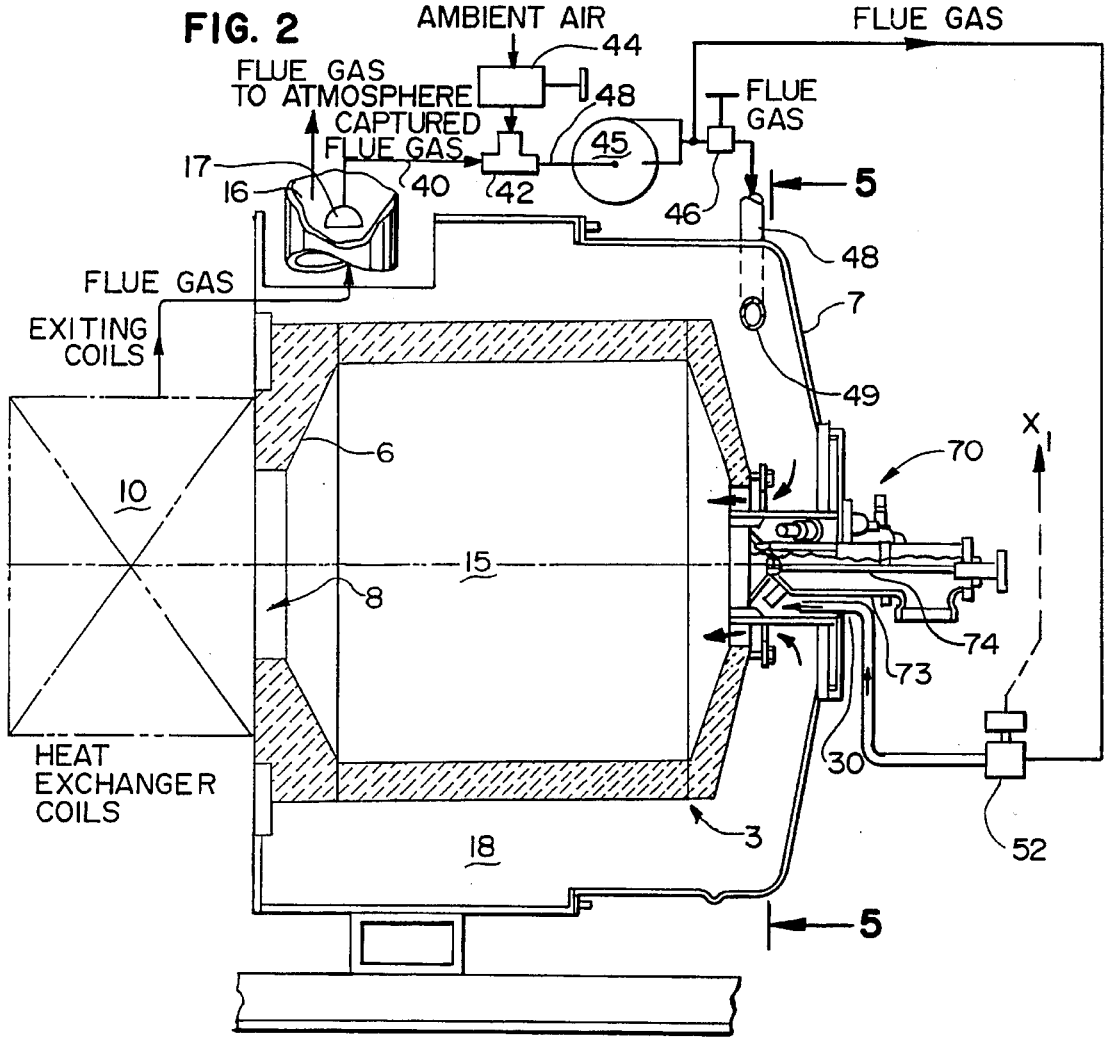
FIG. 2 shows a first embodiment of the invention in diagrammatic, semi-pictorial section, particularly showing the relationship of recirculated flue gas injected into the burner and combustion air plenum. The structural relationship between the boiler combustion chamber and burner are also shown.
Figure 3:
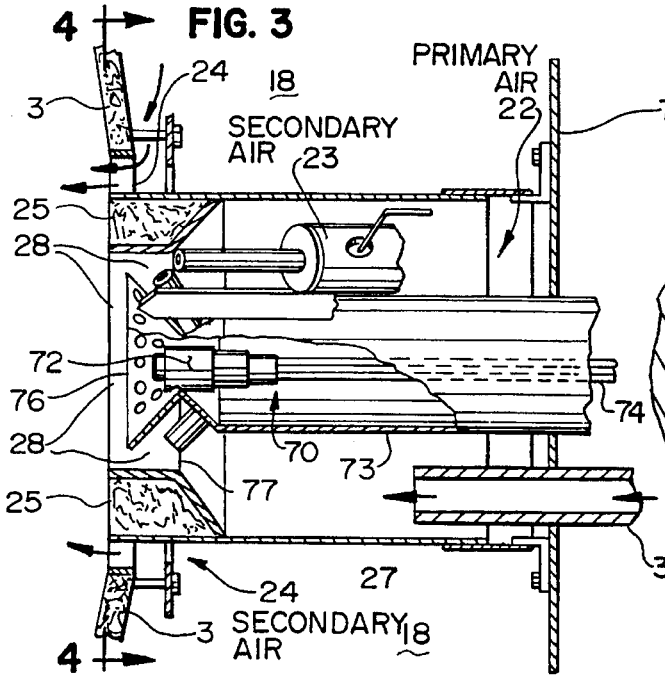
FIG. 3 is an enlarged cross-section of the burner of FIG. 2 including its mounted location internal of the combustion air plenum, and particularly showing the liquid fuel nozzle and primary air flue gas injection port.
Figure 4:
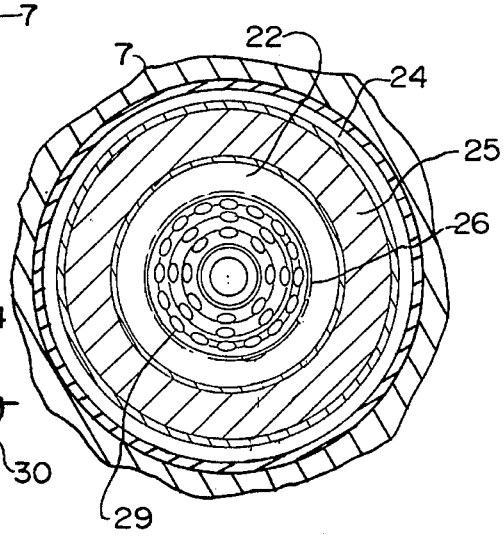
FIG. 4 is a section along the lines of 4—4 of FIG. 3, particularly showing the flame holding cone and liquid fuel nozzle location.
Figure 5:
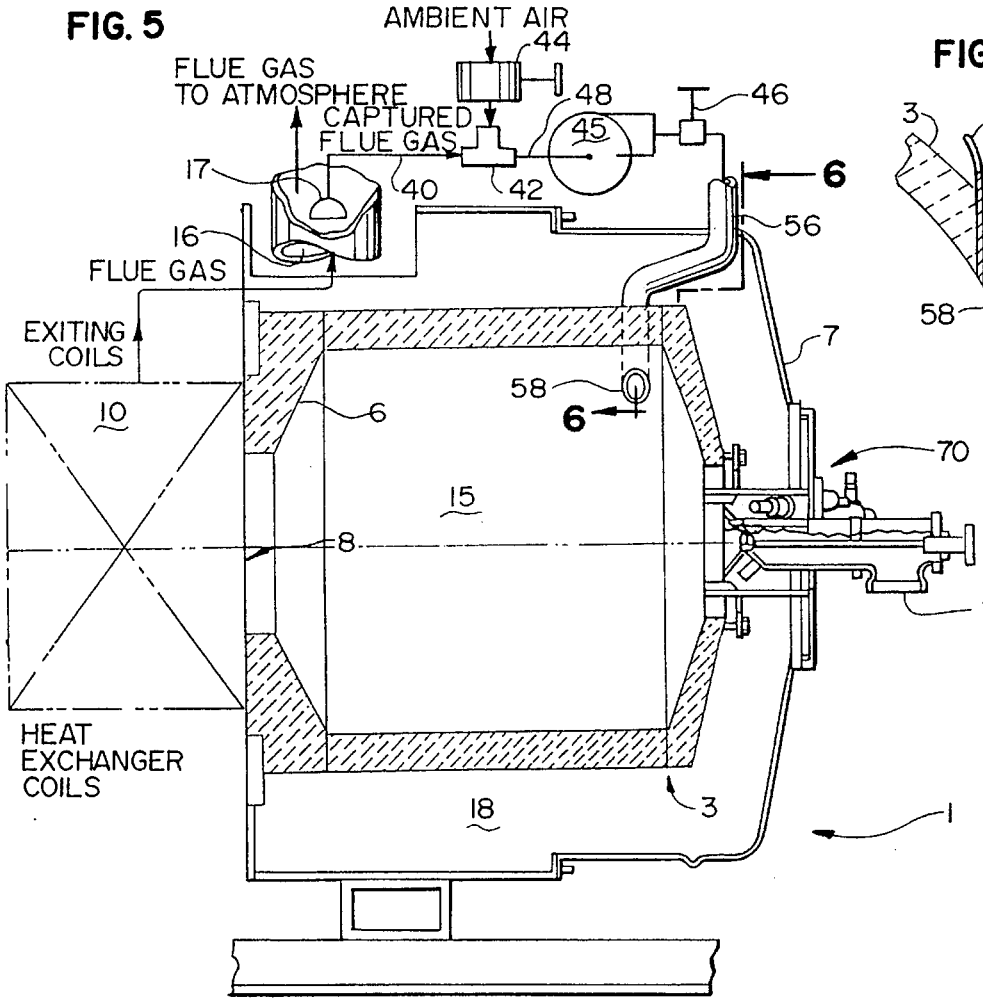
FIG. 5 is a diagrammatic semi-pictorial representation of an alternate embodiment of the invention, particularly showing flue gas recovery, and flue gas injection into the combustion chamber of the boiler.

In particular reference to FIGS. 2, 3 and 4, a preferred embodiment of the flue gas recirculating system (FGR) 2 of FIG. 1 is shown in detail. As shown in FIG. 20, a portion of the flue gas exiting the heat exchange system 10 via the outlet stack 16 is captured by a scoop 17, carried by duct 40 to tee 42 and further carried by duct 43 to the inlet of flue gas blower 45. The tee 42 combines flue gas with ambient air controlled by valve 44 with flue gas entering the blower 45. Flue gas exiting the blower 45 travels through control valve 46 through injecting duct 48 and enters the compact boiler plenum 18 via flue gas exit orifice 49. Additional amounts of flue gas exiting the blower 45 are carried via duct 50 through control valve 52 and burner inlet duct 50 to the burner outer shell 27 of the burner assembly 71 via inlet port 30. With reference to FIGS. 3 and 4, the burner shell 27 is contained intermediate the boiler outer shell 7 and combustion chamber wall 3 with primary and secondary air ports 22 and 24, respectively, supplied from plenum 18, the flue gas injection via 30 provides a flue gas/primary air mixture within the burner outer shell 27. Also shown within the shell 27 is a pilot assembly 23.

Burner assembly 70 further consists of a support tube 73 for containing liquid fuel nozzle 72, and liquid fuel supply 74. Nozzle 72 may be of the type disclosed in U.S. Pat. No. 4,191,505, the specification thereof being incorporated by reference hereto.

In continuing reference to FIG. 2 and FIGS. 3 and 4, annular secondary air inlets 24 are shown. Also shown is a virtual annular primary air inlet orifice 22 defined by mounting the burner end of support tube 73 within the end of shell 27 adjacent the combustor end 3 of combustion chamber 15. An orifice is defined by an annular conoidal flame holder ring 76 and a combustion assembly comprised of a series of gaseous fuel nozzles 28 positioned internal of the shell 27. The nozzles 28 are not used when boiler is fired by liquid fuels and nozzle 72 is employed. As shown in FIG. 4 the flame spreading member further contains a multiplicity of flame holding orifices or perforations 29.

In operation, liquid fuel entering the burner assembly 71 via inlet 74 is atomized by the nozzle 72. With the fuel nozzle 72 positioned as shown, concentrically mounted within the support tube 73, a mixture of primary air entering orifice 77, and atomized fuel exiting the nozzle 72 are mixed and ignited by the pilot assembly 23. Combustion gases are then propelled into the combustion chamber 5. Secondary air entering combustion chamber 5 via ports 24 contributes to combustion therein. Since flue gas entering the inlet port 30 also mixes with the primary air internal of an annular space defined by the outer surface of gas tube 35 and the inner surface of outer shell 27, flue gas mixing occurs in the combustion process at the point of fuel entrance into the combustion process.

Applicants have discovered, as shown in FIG. 2, that injecting properly controlled amounts of flue gas in both the combustion air plenum 18, and simultaneously into the burner primary air mixing annulus 19 provides a substantial reduction in the NOX content of gases exiting the heat exchange section and entering the stack 16.

The essential nature and location of flue gas injection into the combustion air plenum 18 is shown in FIG. 2. As shown, flue gas enters the chamber or plenum 18 via duct 48 and orifice 49 flows tangentially in the annular inter-space or plenum 18 between the outer surface of chamber 3 and the boiler outer shell 7.

Typically, in a compact boiler of the size found to be widely accepted in the marketplace, approximately 22% of the total flue gas stack flow would be recirculated, gas flow apportioned between the burner and combustion plenum approximately 14% and 86%, respectively, of the total. It should be noted that these figures are maximum recirculation at maximum boiler output, the control system utilized in the invention apportions these in varying amounts as determined by the boiler or heater firing rate, which in turn, as indicated earlier, is controlled by the output steam demand or heater thermal load.

Figure 6:
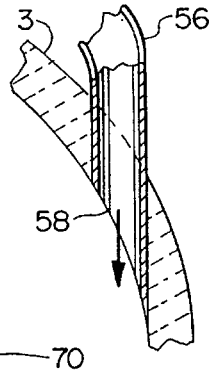
FIG. 6 is a partial section through the line 6—6 of FIG. 5 particularly showing the structure used to inject flue gas into the boiler combustion chamber.

An alternate embodiment of the invention is particularly shown in FIGS. 5 through 8. As in the first embodiment, incorporating a liquid fuel burner assembly 70, a controlled amount of flue gas exiting the boiler exhaust stack 16 is carried via ducts 40 and 43, through mixing tee 42, adding ambient air through valve 44, into the inlet of FGR blower 45. However, in a distinct departure from the first embodiment, flue gases exiting the blower 45 pass through the annular combustion air plenum 18 (reference FIG. 18) and enter the combustion chamber 15 directly through duct 56 and combustion chamber inlet orifice 58. With reference to FIG. 6, the method of tangentially injecting flue gas into the combustion process is shown by the location of orifice 58 where duct 56 enters the wall 3 of combustion chamber 15.

Figure 7:
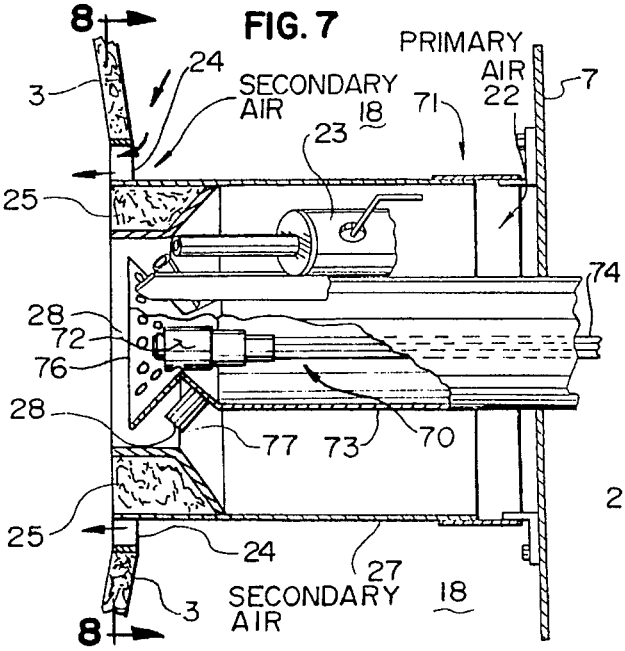
FIG. 7 is an enlarged section through the burner of FIG. 6, particularly showing the flame holding, flame spreading cone, liquid fuel nozzles, and annular secondary air ports.
Figure 8:
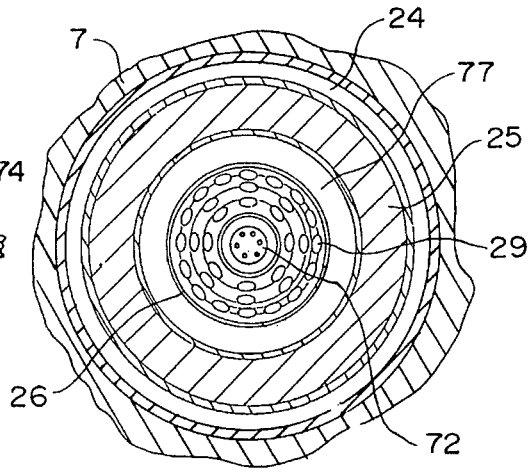
FIG. 8 is a section through lines 8—8 of FIG. 7 showing the conical flame stabilizing/flame holder cone of the burner and liquid fuel nozzle.

In FIG. 6, the location of flue gas inlet orifice 58 is shown in section, entering the combustion chamber 15 in a flow pattern tangential to the chamber inner surface, thereby providing improved mixing of recirculated air flue gas mixture now added directly into the combustion process. FIGS. 7 and 8 show, in greater detail, the burner of the invention, particularly showing the liquid fuel burner assembly 70, liquid fuel nozzle 72, liquid fuel supply 74, and perforated conoidal flame holder or spreader 76. Nozzle 72 is concentrically mounted in support tube 73. Also shown are primary air inlet 22, secondary air inlet 24, and annular orifice 77.

Figure 10:
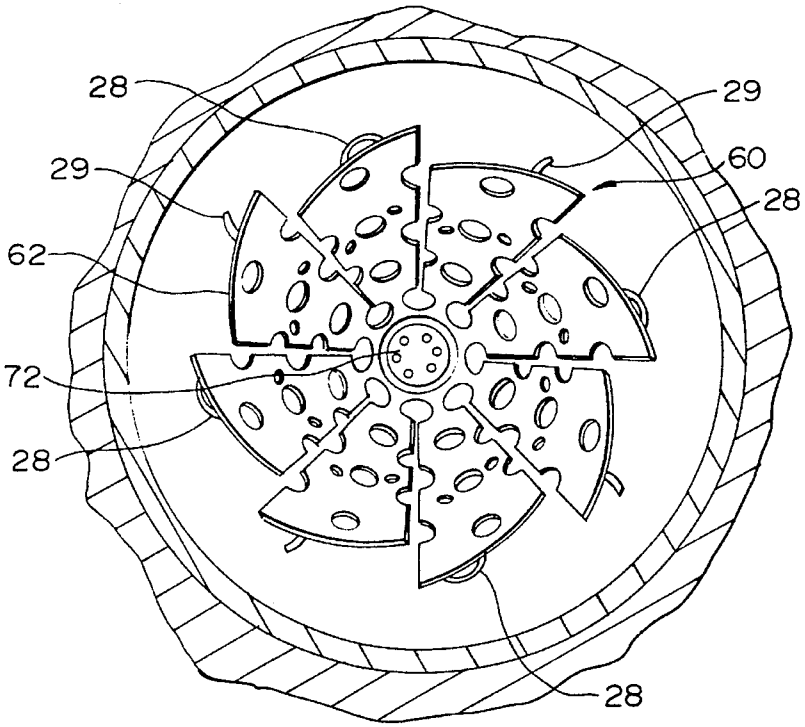
FIG. 10 is a section along the lines 10—10 of FIG. 9, particularly showing details of the modified flame spreading/holding cone of the invention in its relationship to the liquid fuel nozzle.
Figure 9:
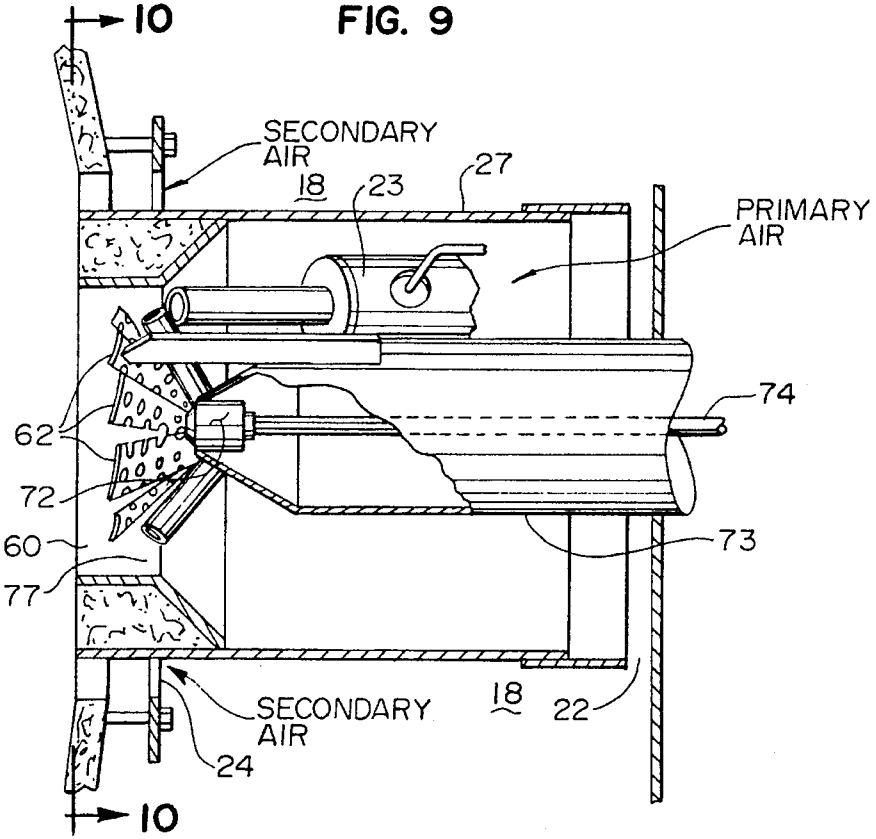
FIG. 9 is a cross sectional showing an alternate embodiment of the burner of FIGS. 3 and 7, particularly showing a modified flame spinning/spreading/flame holding cone of the invention.

An additional embodiment of the invention disclosed, utilizes the burner spreader assembly 60 shown in FIGS. 9 and 10. With particular reference to FIG. 9, there is shown essentially the burners of FIGS. 7 and 8, however, using an improved flame spinning cone incorporating angularly displaced spinning vanes 62. As shown, cone 76 (reference FIG. 7) has been reconfigured to provide a plurality of angularly twisted or offset vanes aligned so as to impart a spinning motion into the mixture of atomized liquid fuel exiting nozzle 72 and primary air and flue gas exiting the burner head assembly annular outlet orifice 77. The use of vanes arranged and located as shown further increase the reduction in NOX emissions through improved flue gas fuel and air mixing prior to entering the combustion process.

Figure 11:
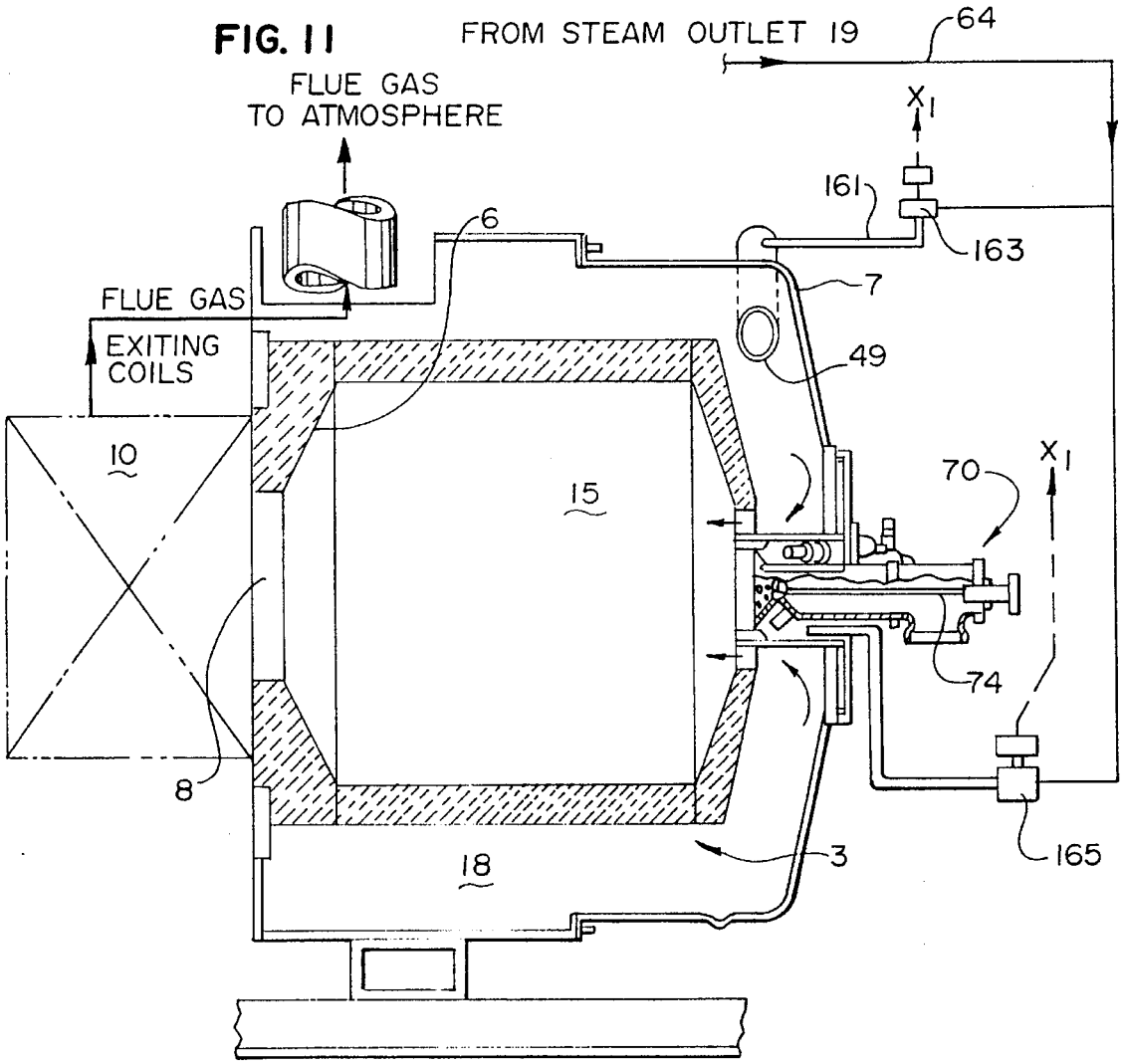
FIG. 11 is a semi-diagrammatical cross section of the boiler of the invention, particularly showing steam introduction into boiler primary and secondary air.
Figure 12:
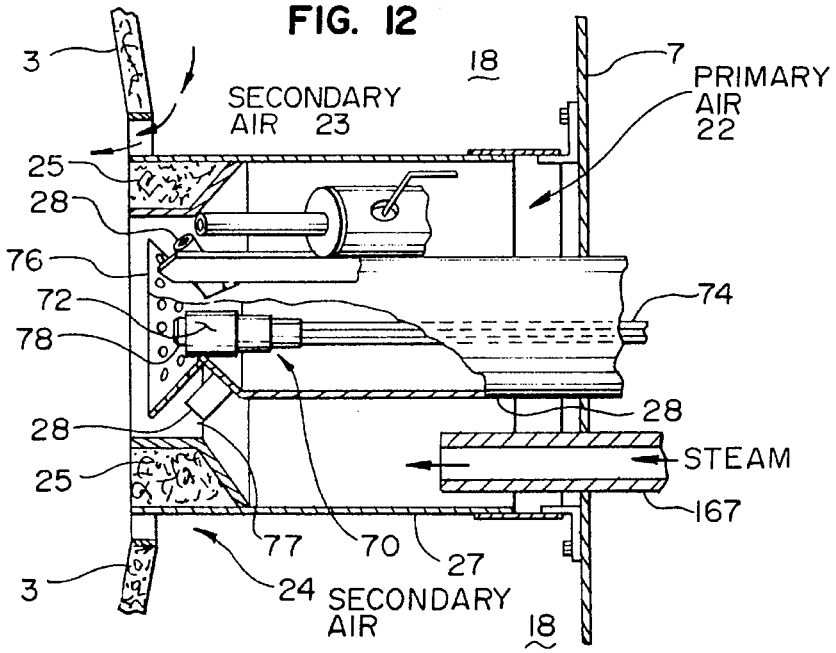
FIG. 12 is a detailed portion of the burner assembly of FIG. 23 in situ, particularly showing the liquid fuel combustion assembly and steam introduction to the primary air of the burner.

FIGS. 11 and 12 show a further embodiment of the invention disclosed wherein stack emissions from a liquid fuel fired compact boiler are reduced through controlled steam induction into the primary and secondary air of the burner. In particular, reference FIG. 12, a liquid fuel burner 70 utilizes a nozzle 72 mounted in a support tube 23 with the burner liquid fuel supply line 74 extending through the support tube. The liquid fuel burner further utilizes a serrated conoidal flame holder 76 surrounding the exit orifices 78 of nozzle 72.

To achieve the reduction in stack emission NOX content, steam obtained either from steam outlet 19 of the boiler drum 5 through line 64 or the steam generating components 90 (reference FIG. 11) to be later described in more detail, is admitted into the burner plenum 18 via conduit 161 and orifice 149. Steam flow is controlled by valve 163.

Similarly, steam outlet from the above-mentioned sources is admitted into the burner primary air through an inlet 167 in the burner shell 27. Primary air steam introduction to the boiler burner is controlled by valve 165. It should be noted that both valves 163 and 165 are controlled by delivered steam pressure at outlet 19 of the boiler sensed by controller 32. Also, liquid fuel delivery to the nozzle fuel supply 74 is also controlled by the pressure controller 32 acting on the liquid fuel metering valve 68 (reference FIG. 1).

A further embodiment of the invention disclosed incorporates novel sources of steam obtained from certain boiler components. With reference to FIG. 13, the sources of steam utilized in reducing NOX emission to be introduced into the boiler plenum and burner primary air are depicted in FIG. 13 as steam source 90. Steam source 90 has several forms and will be discussed in detail with reference to FIGS. 14, 15 and 16.

Figure 14:
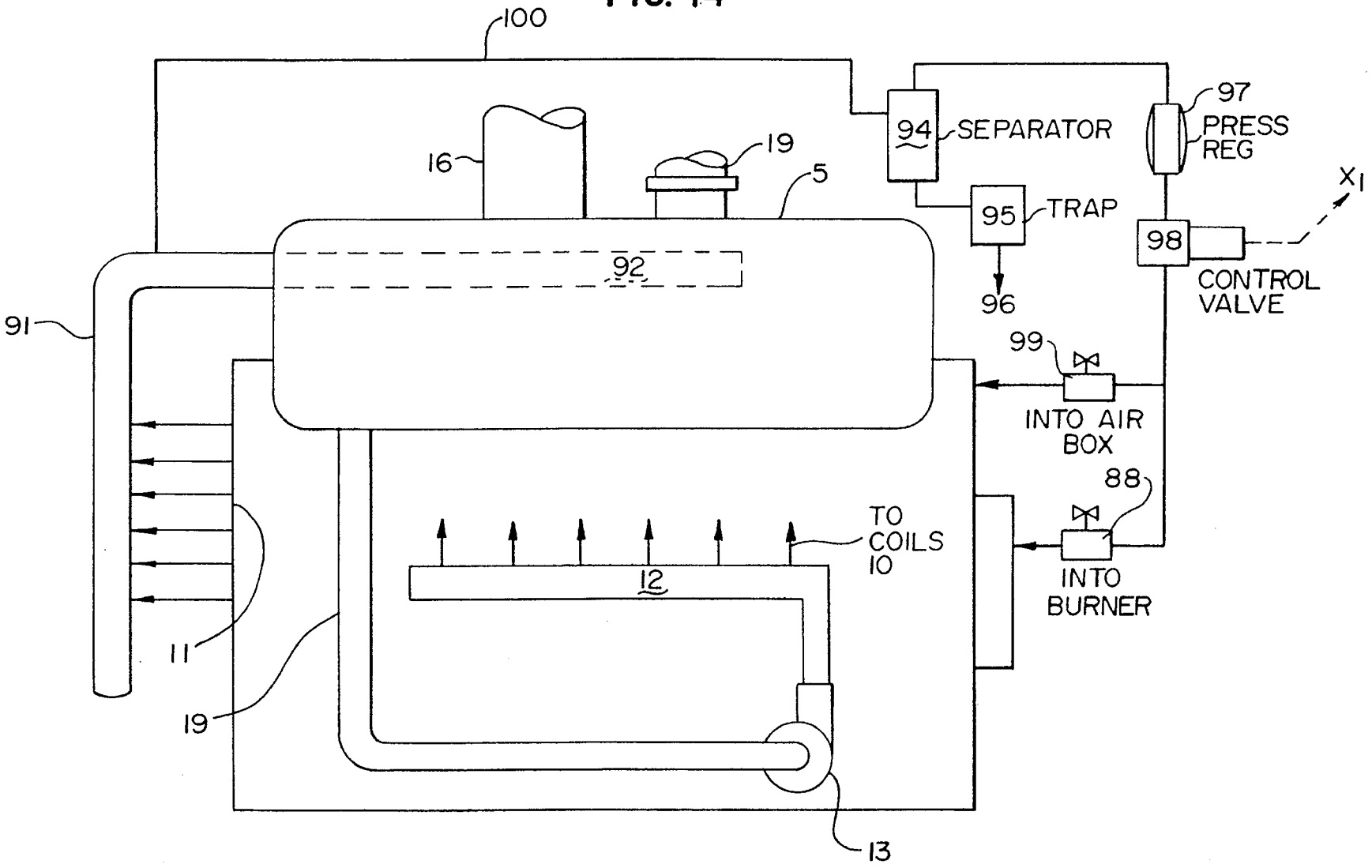
FIG. 14 is a detailed view of the steam source (shown in block form in FIG. 13). In particular sources of steam obtained from superheated water and introduction to the boiler burner is shown.

With particular reference to FIG. 14, there is shown the steam drum 5 of the invention equipped with the steam lance 92. Also shown is a pump 13 utilized to recirculate superheated water from the liquid content of the drum 5 to the coils via coil inlet manifold 12. The heated water is carried from the drum liquid portion to the pump via conduit or pipeline 19. Superheated water exiting the coils 10 (reference FIG. 1) of the boiler is collected in a coil outlet manifold 11 and pumped to the steam lance 92 via conduit or header 91. In the embodiment of FIG. 14, superheated water from the coil outlet conduit 91 is delivered via conduit 100 to a steam separator 94. In steam separator 94, the superheated water is somewhat reduced in pressure and temperature resulting in a mixture of steam and water. The separated steam is supplied to regulator 97 for delivery at a predetermined inlet pressure to the boiler plenum via conduit 61 and plenum inlet 149 or burner primary air via inlet 167 (reference FIG. 13) any residual water is removed through trap 95 and drain 96. In order to adjust the apportionment of steam introduced to the boiler, trim valves 88 and 99 are used to adjust the steam volume flow into the burner primary and secondary air, respectively. Valve 98 is as shown under control of the steam pressure actuator 32 and is, therefore, varied with boiler outlet or delivered steam pressure.

Figure 15:
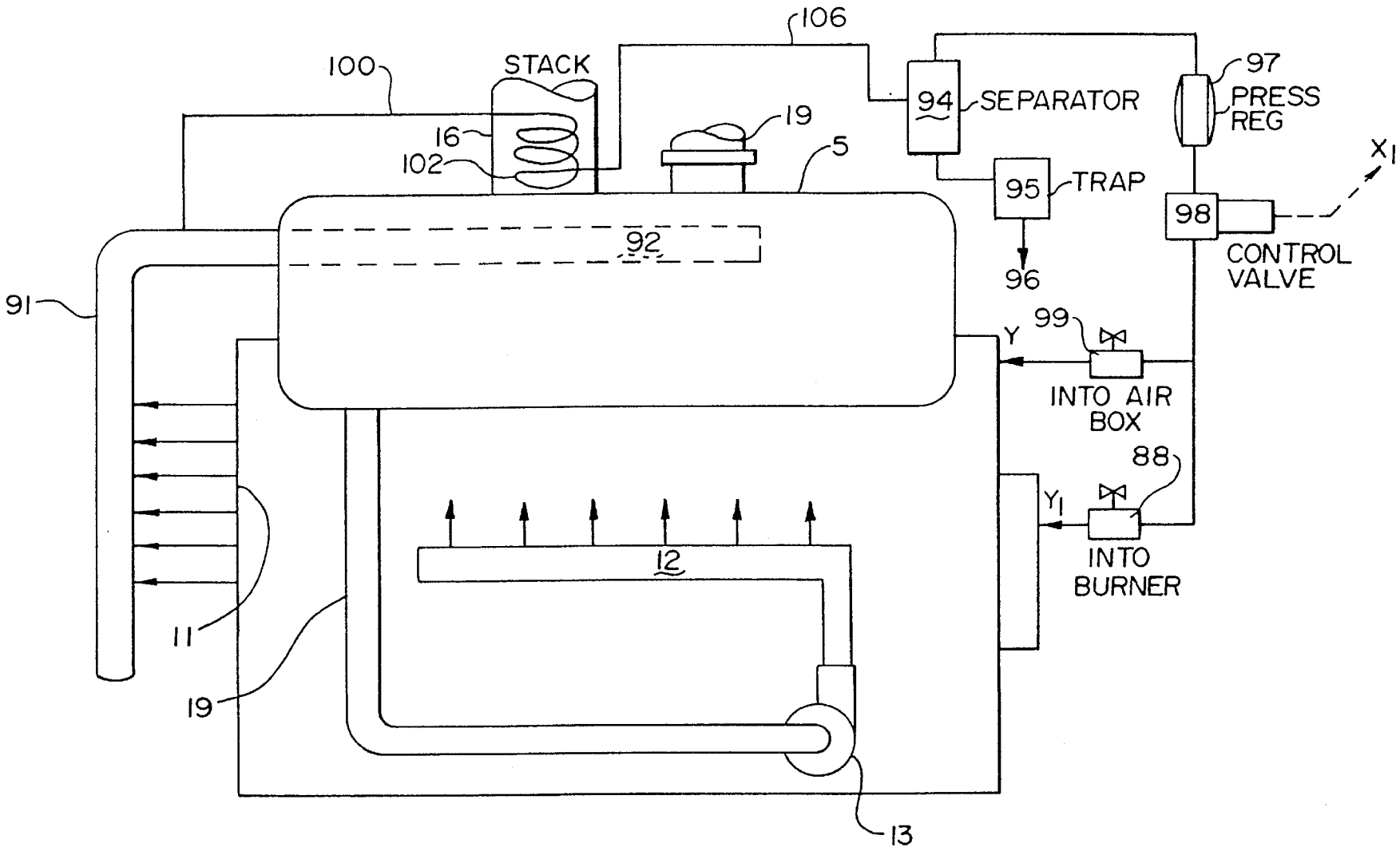
FIG. 15 is an additional embodiment of the block steam source of FIG. 13, particularly showing a superheated liquid steam source boosted in temperature through heat recovery in the boiler stack.

The embodiment shown in FIG. 15 contains superheated water from the coil manifold outlet line 91 as previously discussed. However, in order to insure that the level of superheat is sufficient to deliver required steam, line 100 delivers the coil outlet superheated water to a stack mounted heat recovery unit 102 via line 100. After passing through the stack superheater, line 106 carries the superheated water to separator 94 and then through regulator 97 and control valve 98 for introduction to the combustion process via burner primary and secondary air as discussed above.

Figure 16:
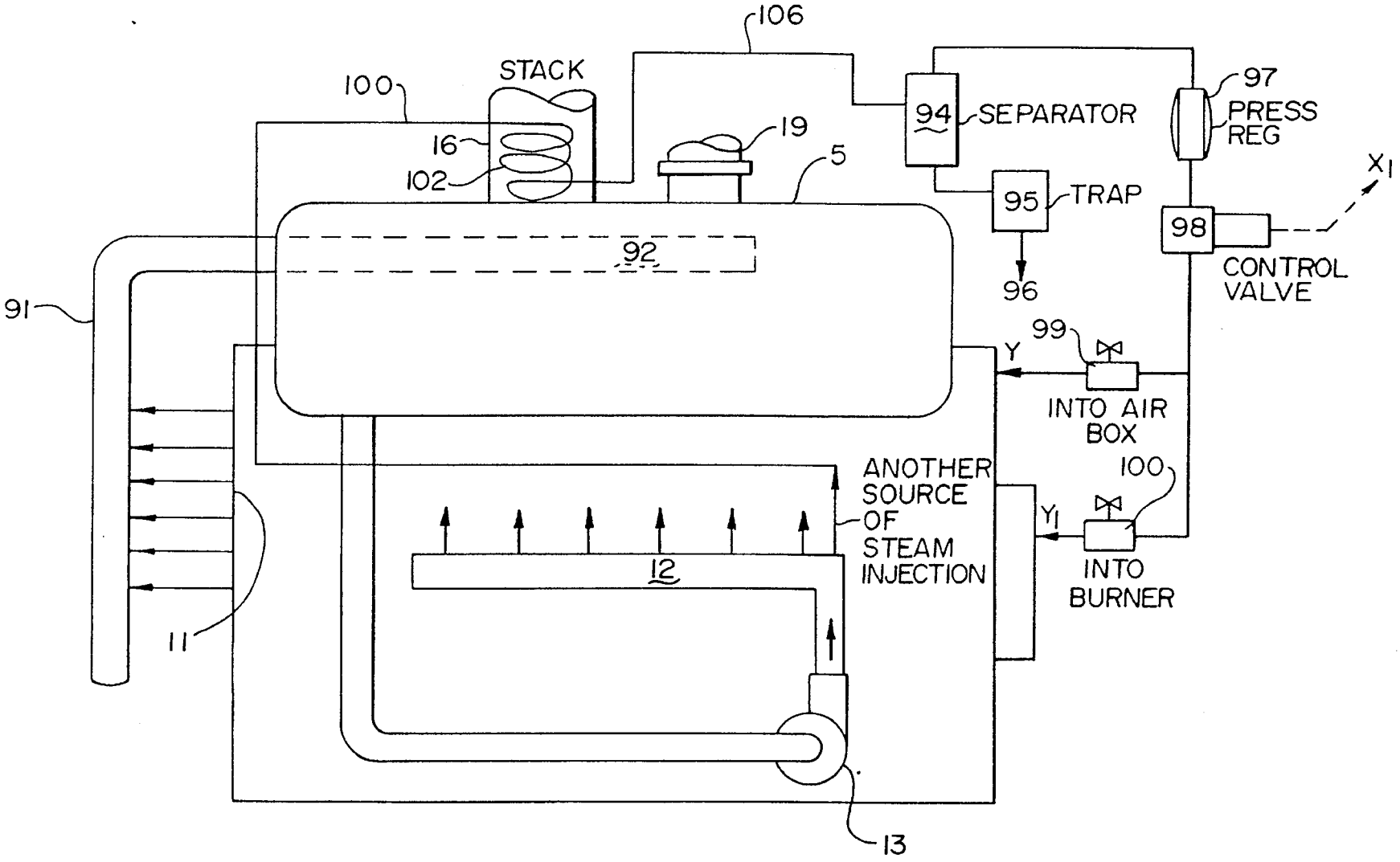
FIG. 16 is an additional detailed representation of the steam source block of FIG. 13, particularly showing the steam source as superheated water from the boiler recirculating pump having its heat input increased through heat recovery in the boiler stack.

An additional embodiment disclosing a novel steam source is shown in FIG. 16. In this case, superheated water is obtained from the coil inlet manifold 12 (reference FIG. 1). Manifold 12 is supplied with superheated water returned from the drum 5 by pump 13. As in the above described embodiment, superheated water from the coil manifold 12 is passed through the stack heat recovery means 102 via conduits or lines 100 and 106. Superheated water now increased in superheat is passed through separator 94 thereby supplying higher quality steam to regulator 97. This steam now passes through control valve 98 for delivery to the boilers, burner, primary and secondary air via trim valves 99 and 100, respectively.

As shown in conjunction with flue gas recirculation, applicants submit that utilizing steam injection is, therefore, an important advancement in the art of NOX reduction, particularly for compact boilers of the type disclosed herein.

In a "typical" steam generator of a popular size and capacity, steam injection as shown comprises approximately 1.5%–2.46% of the total maximum boiler steam delivery to a given load.

As indicated above, applicants have discovered that recirculating combustion flue gas by injecting gases at certain heater locations corresponding to critical points in the combustion processes of a compact fluid heater have provided reductions in NOX content of stack gases as required by recent environmental considerations.

Applicants further discovery that injecting properly controlled amounts of steam into the combustion process via the burner combustion air is a further low cost, easy to adjust, and effective method of reducing NOX content in the stack emissions of a compact boiler. Combinations of the steam and recirculated flue gas are also part of applicants' discovery.

The novel approaches to obtaining steam from strategic locations internal of the steam generating system of a compact boiler have been disclosed in three embodiments. In particular, these methods result in providing steam for boiler emission NOX reduction which supply steam at improved boiler efficiencies. As such, these approaches constitute a novel and unobvious method of supplying steam for NOX reduction.

The novel and inexpensive approaches disclosed herein are easy to adjust, low cost, and conform to existing emission regulations with a minimum of boiler redesign.

Thus, it is apparent that there has been provided in accordance with the invention, modifications in a compact boiler resulting in reducing NOX levels in boiler exhaust gases, that fully satisfy the objects, aims and advantages set forth above.

While liquid fuel fired compact boiler combustion systems utilizing flue gas recirculation systems steam introduction and apparatus disclosed have been described in conjunction with specific embodiments thereof, it is evident that many alternatives, modifications and variations will be apparent to those skilled in the combustion arts and in the light of the foregoing description. Accordingly, it is intended to embrace all such alternatives, modifications, and variations as may fall within the spirit and broad scope of the appended claims.

What is claimed as new and desired to be secured by Letters Patent of the United States are:

1. In combination, a compact fluid heater comprising:

a combustor for generating heat including high temperature combustion products, comprising:

an essentially cylindrical combustion chamber having oppositely disposed ends;

a centrally located passage at one said chamber end for venting said combustion products;

a burner in the other said chamber end comprising:

an essentially cylindrical outer shell having inlet and outlet ends;

means mounting said shell outlet end in said chamber adjacent said chamber burner end, said mounting means and shell outlet end defining a secondary air inlet to said burner;

a support tube coaxially disposed in said shell, said tube having first and second ends, said second tube end adjacent said secondary air inlet;

an annular orifice defined by said shell outlet end and support tube second end;

a liquid fuel nozzle having a discharge end in said annular orifice, and a supply end extending into said support tube;

means supplying liquid fuel to said nozzle supply end; and means supplying primary combustion air to said outer shell inlet end; and, means supplying combustion air to said secondary air inlets; and, a coaxially disposed heat exchanger having internally flowing fluid for receiving said combustion products and absorbing heat by flow of combustion products therethrough, thereby heating said fluid, said combustion products collected in an outlet,;

stack means in fluid communication with said exchanger outlet for exhausting said gases to the atmosphere;

means in said stack means capturing a controlled amount of said exhaust gases;

means injecting said captured gas into said combustor supply means;

means in said supply means, proportioning said captured gas among said primary and secondary combustion air inlets.

2. The combination of claim 1 further comprising:

a perforated conoidal member on said support tube second end, said member surrounding said nozzle.

3. The combination of claim 2, wherein said conoidal member further comprises:

an essentially conical member having inner and outer ends, said ends defining a base plane;

a plurality of vanes extending from said inner end, each said vane having an angular deviation from said base plane.

4. The combination of claim 3 wherein said angular deviation is in a range of 25° to 35°.

5. In combination, a compact fluid heater comprising:

a combustor for generating heat including high temperature combustion products comprising:

a combustion chamber having inlet and outlet ends for generating high temperature combustion products from combusting fuel and air therein;

a burner mounted at said chamber inlet end for supplying combusting fuel and air, thereby generating and delivering said combustion products to said chamber inlet end comprising:

an essentially cylindrical outer shell having inlet and outlet ends, said outlet end adjacent said combustion chamber inlet;

a burner secondary air inlet defined by said shell outlet and chamber inlet ends;

a support tube coaxially disposed in said shell, said tube having first and second ends, said second tube end adjacent said secondary air inlet;

an annular orifice defined by said shell outlet end and support tube second end;

a liquid fuel nozzle, having a discharge end in said annular orifice and a supply end extending into said support tube;

means supplying combustion air to said shell inlet end and secondary air inlet; and, heat exchange means in fluid communication with said combustion chamber outlet end, said heat exchange means receiving combustion products from said chamber and extracting heat therefrom, said exchanger having an outlet for exhausting said combustion products to the atmosphere;

means capturing a predetermined amount of said combustion products;

means injecting said captured combustion products into said combustion chamber.

6. The combination of claim 5 further comprising:

a perforated conoidal member on said support tube second end, said member surrounding said nozzle.

7. The combination of claim 6, wherein said conoidal member further comprises:

an essentially conoidal member having inner and outer ends; said ends defining a base plane;

a plurality of vanes extending from said inner diameter, each vane having an angular deviation from said base plane.

8. The fluid heater of claim 7 wherein said angular deviation is within a range of 25° to 35°.

9. The fluid heater of claim 5 wherein said combustion chamber capturing and injecting means further comprise:

a wall, intermediate said combustion chamber ends, a blower for delivering said captured combustion gases to said chamber;

an orifice in said chamber wall for injecting said combustion products into said chamber;

means conducting said delivered combustion gases to said orifice;

wherein said delivered combustion gases enter said combustion chamber and modify the ongoing combustion process.

10. In combination, a compact steam generator comprising:

a combustor for generating heat including high temperature combustion products, said combustor having a source of liquid fuel, and supply means for admitting primary and secondary combustion air, and steam thereto; and, means supplying combustion air to said supply means;

a coaxially disposed heat exchanger having internally flowing fluid for absorbing said combustor generated heat by flow of said gaseous combustion products therethrough, and generating steam thereby;

means collecting said gaseous combustion products;

stack means in fluid communication with said collecting means for exhausting said gases to the atmosphere;

means in said stack means capturing a controlled amount of said gases;

means in said heat exchanger for capturing a controlled amount of steam generated therein;

means supplying said captured gas and steam to said supply means; and means in said combustion air and steam supply means proportioning said captured gas and steam among said combustor inlets.

11. The combination of claim 10 wherein the combustor further comprises:

an essentially cylindrical combustion chamber having oppositely disposed ends;

a centrally located circular vent at one said chamber end;

a burner in the other said chamber end comprising:

an essentially cylindrical outer shell having inlet and outlet ends;

means mounting said shell outlet end in said chamber adjacent said chamber burner end, said mounting means and shell inlet end defining a secondary combustion air inlet to said burner;

a support tube coaxially disposed in said shell, said tube having first and second ends, said first end adjacent said shell outlet end, and said second tube end adjacent said secondary combustion air inlet;

an annular orifice defined by said shell outlet end and support tube second end;

a liquid fuel nozzle, having a discharge end in said annular orifice, and a supply end extending into said support tube;

means supplying liquid fuel to said supply end;

means supplying primary combustion air to said outer shell inlet end;

means supplying combustion air to said primary air inlet;

a perforated conoidal member on said support tube second end, said cone surrounding said nozzle.

12. The steam generator of claim 11 wherein said conoidal member further comprises:

an essentially conical member having inner and outer ends, said ends defining a base plane;

a plurality of vanes extending from inner end, each vane having an angular deviation from said base plane;

wherein said cone imparts a helical trajectory to combusting gaseous fuels, primary air and steam passing through said shell outlet end and into said chamber.

13. The steam generator of claim 12 wherein said angular deviation is in a range of 25° to 35°.

14. The steam generator of claim 10, wherein said combustor and proportioning means further comprise:

a combustion chamber for generating high temperature combustion gases, said combustion chamber having inlet and outlet ends and a side wall, said side wall defining an inlet orifice, said orifice providing fluid communication through said side wall and into said chamber;

a burner mounted at said chamber inlet end for supplying combusting fuel and air to said chamber;

means fluid communicating said chamber outlet and heat exchanger;

means in said proportioning means for injecting said captured combustion products through said inlet orifice;

wherein proportioned amounts of gaseous combustion products enter said chamber, thereby modifying the ongoing combustion process.

15. The steam generator of claim 10 wherein the combustor further comprises:

an essentially cylindrical combustion chamber having oppositely disposed inlet and outlet ends;

a centrally located circular vent in said chamber outlet end;

a burner in said chamber inlet end comprising:

an essentially cylindrical outer shell having inlet and outlet ends;

means mounting said shell outlet end in said chamber adjacent said chamber inlet end, said chamber inlet end and shell outlet end defining a secondary air inlet to said burner;

a support tube coaxially disposed in said shell, said tube having first and second ends, said second tube end adjacent said secondary air inlet;

an annular primary air inlet defined by said shell inlet end and gas supply tube second end;

a liquid fuel nozzle having a discharge end in said annular orifice, and a supply end extending into said support tube;

means supplying liquid fuel to said supply end;

means supplying primary combustion air to said primary and secondary air inlets; and, a perforated cone on said tube second end, said cone surrounding said nozzle.

16. The steam generator of claim 15 wherein said cone comprises a plurality of vanes extending from an inner diameter, each vane having an angular deviation from base plane of said cone;

wherein said cone imparts a helical trajectory to combusting gaseous fuels, primary air and steam passing through said shell outlet end and into said chamber.

17. The steam generator of claim 16 wherein each vane angular deviation is in a range of 25° to 35°.

18. In combination, a compact steam generator comprising:

a combustor for generating heat including high temperature combustion products, said combustor having a source of fluid hydrocarbon fuel, and supply means for admitting primary and secondary combustion air, and steam thereto;

means supplying combustion air to said supply means;

means generating steam comprising:

heat exchange means in fluid communication with said combustor, said heat exchange means having internally flowing fluid therein for transferring said combustor generated heat to said fluid, by flow of said combustion products therethrough, thereby increasing the temperature and pressure of said fluid;

means controllably reducing said fluid temperature and pressure, thereby generating steam and residual fluid;

means in said steam generating means for capturing a controlled amount of said steam generated therein;

means supplying said captured steam to said supply means; and, means in said supply means proportioning said captured steam among said primary and secondary combustor air.

19. The combination of claim 18 wherein the steam generating means further comprises:

means returning said residual fluid to said steam generating means;

stack means in fluid communication with said heat exchange means for exhausting said combustion products to the atmosphere;

means in said stack means transferring heat from said combustion products to said residual fluid.

20. The combination of claim 18 wherein the steam generator means further comprises:

means in said stack means transferring heat from said gaseous combustion products to said internally flowing heat exchanger fluid.

21. The combination of claim 18 further comprising:

means collecting said combustion products;

stack means in fluid communication with said collecting means for exhausting said combustion products to the atmosphere;

means in said stack means capturing a controlled amount of said combustion products;

means supplying said captured combustion products to said supply means;

whereby controlled amounts of said captured steam and combustion products are apportioned among said combustor primary and secondary combustion air.

22. The combination of claim 18 wherein said fluid hydrocarbon fuel is gaseous fuel.

23. The combination of claim 18 wherein said fluid hydrocarbon fuel is liquid fuel.

24. A method for reducing the NOX level in stack gas exhaust from a compact fluid heater for supplying heat according to thermal demands, said generated heater having a combustor for generating heat, said heat including high temperature flue gas, and heat exchange means in said heater for extracting heat from said combustor, and an exhaust stack for discharging flue gas to the atmosphere, comprising the steps of:

utilizing a burner in said combustor for generating heat and flue gas, said combustor utilizing fluid fuel and having primary and secondary air inputs thereto;

incorporating a heat exchanger, having internally circulating fluid, said fluid absorbing heat from said combustor;

heating said fluid by said absorbed heat to temperatures above saturation, thereby generating superheated fluid;

reducing temperature and pressure of said superheated liquid, thereby generating steam;

capturing a controlled predetermined amount of said steam;

apportioning said steam among said primary and secondary air inputs;

controlling said apportioned steam in accordance with liquid fuel input as required by heater load demand.

25. The method of claim 24 further comprising the steps of:

capturing a controlled amount of flue gas;

apportioning and injecting said captured flue gas among and into said primary and secondary air inputs.

* * * * *